United States Patent [19]

Best et al.

[11] 4,424,693

[45] Jan. 10, 1984

[54] KEY-REMOVABLE LOCK CORE

[75] Inventors: Walter E. Best; William R. Foshee, both of Indianapolis, Ind.

[73] Assignee: Best Lock Corporation, Indianapolis, Ind.

[21] Appl. No.: 204,290

[22] Filed: Nov. 5, 1980

[51] Int. Cl.[3] ..... E05B 27/02

[52] U.S. Cl. ..... 70/369

[58] Field of Search ..... 70/369, 367, 368, 340, 70/364 A, 373

[56] References Cited

U.S. PATENT DOCUMENTS

| | | | |
|---|---|---|---|
| 1,561,771 | 11/1925 | Best | 70/370 |
| 1,656,854 | 1/1928 | Best . | |
| 2,814,941 | 12/1957 | Best | 70/340 |
| 3,206,958 | 9/1965 | Best | 70/373 |
| 3,541,820 | 11/1970 | Best | 70/369 |
| 3,667,264 | 6/1972 | Surko | 70/369 |
| 4,123,926 | 11/1978 | Elder | 70/368 |
| 4,328,690 | 5/1982 | Oliver | 70/369 |

OTHER PUBLICATIONS

Medeco Removable Core—drawing from applicant's copending application No. 239,436.

*Primary Examiner*—Robert L. Wolfe
*Attorney, Agent, or Firm*—Barnes & Thornburg

[57] ABSTRACT

A key-removable core for a lock chamber of figure-8 cross section has a short cylindrical key plug housing fitting the lower lobe of the chamber and a pin tumbler housing containing a series of pin tumbler barrels, two of which are in an extension beyond the key plug housing. A key plug is contained in such housing and a control sleeve aligned with such housing beneath the extension and having pin tumbler bores aligned with said two barrels. Side faces on the pin tumbler housing and spaced from the chamber side wall provide clearance on one side for a retaining lug on the control sleeve retractable into such clearance from core-retaining engagement behind a shoulder in the chamber, and clearance on the other side for a stop lug. An operating key aligns tumblers in all barrels for shear movement at an operating shear line at the outer surface of the key plug. A control key aligns tumblers in the two extension-contained barrels for shear movement at a control shear line at the outer surface of the control sleeve, and tumblers in the other barrels for shear movement at the operating shear line, to permit rotation of the sleeve to retract its retaining lug. The pin tumbler housing may have flat sides which define the lug clearances or may be cylindrical and have clearance recesses cut in it with end faces which ride against the lugs. The core may have a separate face plate, or the pin tumbler housing may itself form the front face of the core.

4 Claims, 10 Drawing Figures

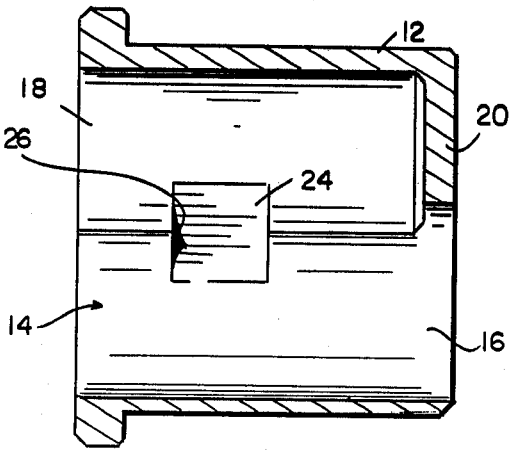
FIG. 4
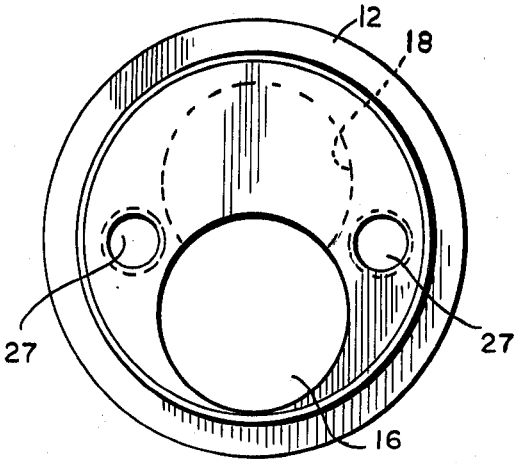
FIG. 5
FIG. 6
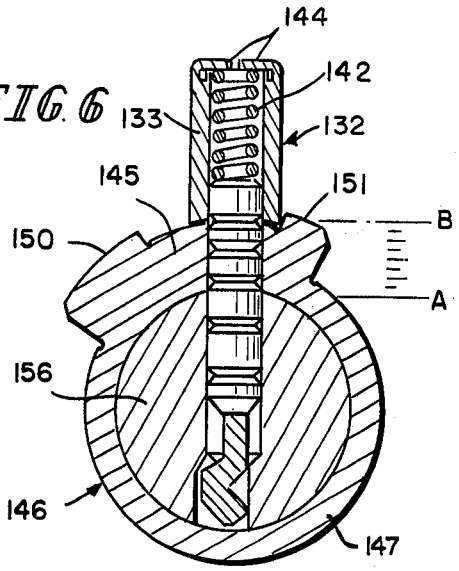
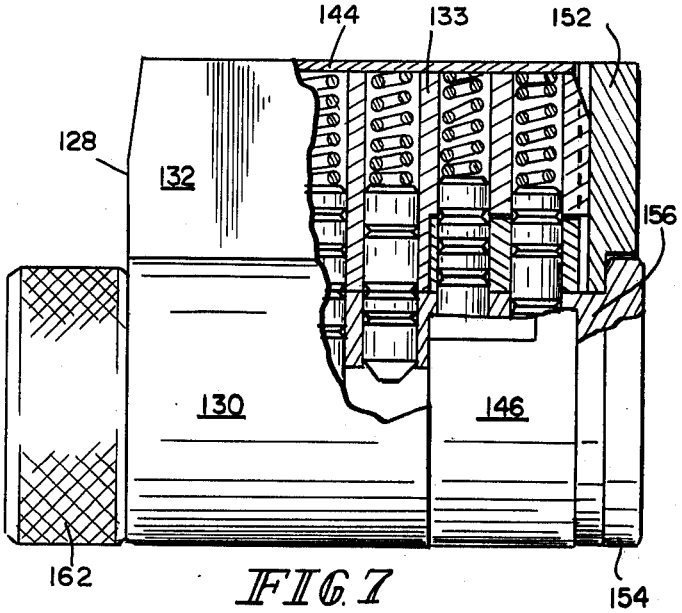
FIG. 7
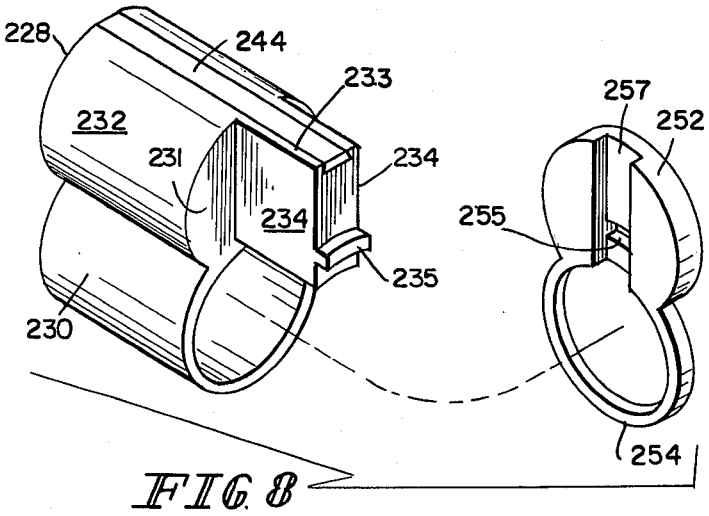
FIG. 8
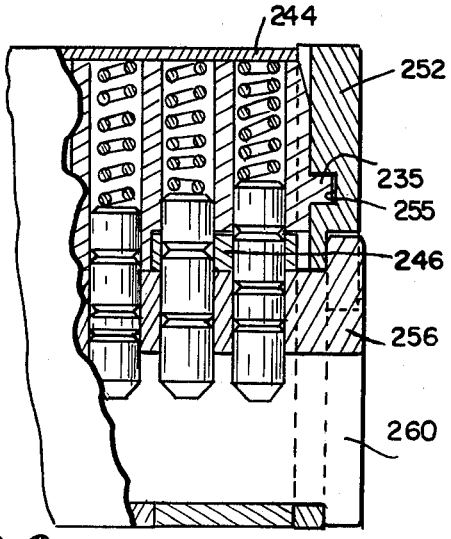
FIG. 9

KEY-REMOVABLE LOCK CORE

This invention relates to a key-removable lock core for use in a lock cylinder, doorknob, or other core receptacle defining a core-receiving opening or chamber.

Key-removable lock cores of the type shown, for example, in FIGS. 1-7 of Frank E. Best U.S. Pat. No. 3,206,958 have been known since the 1920's and have been widely sold and used in a standard configuration and size so as to be readily interchangeable and renewable in the same lock mechanisms. Such standard lock core includes a core body of figure-8 cross section with body a key plug and a full-length thin-walled sleeve within its bottom lobe, the sleeve being rotatable through a limited angle to retract a core-retainer lug thereon. An axial series of pin tumbler barrels extend through the pin tumbler housing formed by the top lobe of the core body, through a thickened portion of the sleeve contained in a broached recess in such upper lobe, and into the key plug. This arrangement forms a full-length operating shear line at the interface between the key plug and the sleeve, and a full-length control shear line at the interface between the thickened portion of the sleeve and the upper lobe of the core body. An operating key will align the tumblers for shear at the operating shear line to allow the key plug to be rotated, while a control key will align the tumblers for shear at the control shear line to allow the sleeve and the key plug together to be rotated to move the retaining lug on the sleeve between a retracted position within the figure-8 profile of the core and a projected position in which such lug is engaged behind a rearward-facing shoulder in the core receptacle to retain the core in such receptacle.

It is an object of the present invention to provide a lock core which is interchangeable by means of a control key in the same manner as with the prior standard form of key-removable core, which avoids the use of a full-length, thin-walled sleeve between the key plug and its housing which permits use of a retaining lug of increased size which facilitates manufacture and increases the strength of the core and its parts and which strengthens the core against pulling and other attack.

It is a further object of the invention to provide a key-removable lock core which functions in the same manner as the prior standard core but which has improved features and is adapted to be fitted to a series of lock mechanisms which have not previously had the benefit of a readily interchangeable lock core.

In accordance with the invention, a key-removable lock core is provided for use in a receptacle which defines a core-receiving chamber or opening having a first portion for axially and slidably receiving the key plug housing of the core and an adjoining second portion for receiving the pin tumbler housing of such core, and having a side wall which defines a rearward-facing shoulder spaced inward from the entrance end of the receptacle for engagement by a core-retaining lug on the core. The core-receiving opening is preferably of figure-8 cross section having inward-projecting ribs at its opposite sides, and the rearward-facing shoulder is formed by cutting a recess or slot through one of such ribs and permissibly therebeyond into the side wall of the receptacle. The core comprises a body having a key plug housing which extends forward from one end of the body toward the other and defines one portion of a cylindrical chamber to receive the rotatable key plug, and the core body also has a pin tumbler housing containing an axial series of pin tumbler barrels. The key plug housing extends axially over a length adapted to support the key plug coaxially in its cylindrical chamber, and the pin tumbler housing has an extended portion beyond the key plug housing over a length containing at least one, and preferably at least two, pin tumbler barrels. A control sleeve is positioned coaxially with the key plug housing of the body and defines a second portion of the cylindrical chamber for the key plug, and such control sleeve contains a pin tumbler bore aligned with each barrel in the extended portion of the pin tumbler housing. The control sleeve carries a radially protruding retaining lug which has a projected position in which it is adapted to engage behind the shoulder formed in the side wall of the core receptacle and is retractable therefrom by rotation of the control sleve to a retracted position against a side face on the pin tumbler housing and within a clearance space formed between such side face and the adjacent side wall of the core receptacle. Such clearance space may be provided by forming the pin tumbler housing as a flat flange with parallel flat sides spaced from the inner periphery of the top lobe of the figure-8-shaped core chamber, but may also be formed by milling away part of the side portions of the upper lobe of a figure-8-shaped core body. The sleeve desirably also carries a small stop lug on the opposite side of the pin tumbler housing from the retaining lug and in a similar clearance space, which stop lug moves inward against a side face of the pin tumbler housing as the retaining lug moves outward to its projected position and which always lies within the figure-8 profile of the core chamber so as not to interfere with removal and insertion of the core in its receptacle.

The interface at the surface of the key plug, between it and the key plug housing and control sleeve, provides an operating shear line to which shear faces in the several pin tumbler stacks can be moved by a suitable operating key to permit the key plug to be rotated for normal lock operation, the control sleeve than being held against rotation by pin tumblers in one or more of the pin tumbler barrels contained in such control sleeve. The interface at the outer surface of the control sleeve, between it and the extended portion of the pin tumbler housing, provides a second or control shear line to which pin tumbler shear faces in the barrels contained in the control sleeve are brought by a suitable control key which also brings shear faces in the other pin tumbler stacks to the operating shear line, so as to permit such control key to rotate the control sleeve through a limited angle to retract the retaining lug from its projected to its retracted position, the control sleeve then being locked to the key plug by pin tumblers in one or more of the control sleeve barrels.

The key plug housing portion of the core body may be at either end of such core body, but in a presently preferred embodiment of the invention, such key plug housing is at the rear and extends forward part way to the front end of the housing, the control sleeve is in front of the key plug housing, and the extended portion of the pin tumbler housing extends forward from the key plug housing across the length of the control sleeve. In such case, especially when the pin tumbler housing is formed with flat parallel sides, such pin tumbler housing is interlocked with a face plate at the front end of the core, which face plate has a lower lobe ring encircling the key plug behind a flange thereon so as to be held in place by such flange on the key plug. Also, the face plate may be keyed to the pin tumbler housing to fix it radially and thereby provide radial support for the front end of the key plug. When the core body is of figure-8 cross section so that the pin tumbler housing forms the upper cylindrical lobe of such body, the pin tumbler housing may extend to and provide the front face for the core.

Further in accordance with one embodiment of the present invention, the control sleeve is a relatively thick-walled cylinder of uniform wall thickness except for the presence of the retaining lug and of the stop lug if a stop lug is used. However, the control sleeve may have a thickened wall portion between the key plug and the overlying extended portion of the pin tumbler housing so as to provide a greater spacing between the operating and the control shear lines and thereby provide a greater number of pin tumbler combinating increments between those two shear lines.

Other and more specific objects and features of the invention will be evident from the following description of a preferred embodiment of the invention and of certain modifications thereof.

The accompanying drawings illustrate the invention and show a preferred embodiment exemplifying the best mode of carrying out the invention as presently perceived. In such drawings:

FIG. 4 is a longitudinal section of the lock cylinder shown in FIGS. 2 and 3, looking in the opposite direction from the section of FIG. 3, and with the core omitted;

FIG. 5 is an end elevation of the lock cylinder shown in FIG. 4;

FIG. 6 is a transverse section of a modification embodying the invention, in which the control sleeve includes a thick-walled segment between the operating shear line and the control shear line;

FIG. 7 is a longitudinal section of the modification shown in FIG. 6;

FIG. 8 is a perspective view of a core body and face plate, showing a further modification;

FIG. 9 is a partial longitudinal section of a core embodying the modification shown in FIG. 8.

Figure 1:
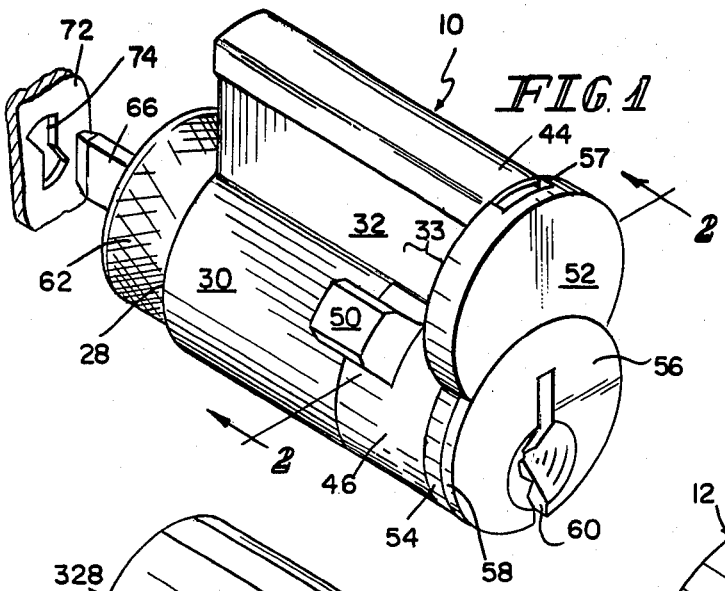
FIG. 1 is a perspective view of a key-removable core embodying the invention in exploded relation with a bolt-retracting element.
Figure 2:
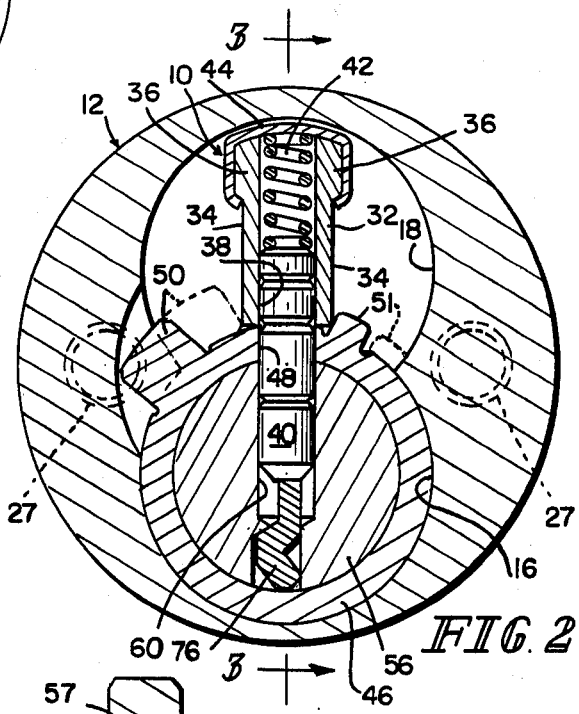
FIG. 2 is a transverse sectional view taken on the line 2—2 of FIG. 1, showing the core mounted in the core chamber of a lock cylinder exemplifying one of several core receptacles with which the key-removable core may be used.

The lock mechanism shown in FIGS. 1–5 comprises a core 10 and a core receptacle 12 in the form of a cylinder of the type commonly used with a tubular lock or a mortise lock. The cylinder contains a core chamber 14 of figure-8 cross section formed by a pair of intersecting parallel bores of equal size. The lower bore forming the lower lobe 16 of the chamber extends through the rear wall of the cylinder, while the upper bore forming the upper lobe of the chamber terminates within the cylinder to leave a rear wall 20 which is engaged by the core as a stop to locate the core in the chamber. The two bores leave a rib 22 along each side of the chamber, and on one side, as shown in FIGS. 2 and 4, a recess 24 is milled through such rib so as to form clearance space for engagement of a core-retaining lug behind the rearward-facing shoulder 26 at the front end of such recess. The rear end of the cylinder contains two bolt holes 28 in standard locations to receive mounting bolts for the cylinder, and such holes terminate short of the shoulder 26, and preferably short of the recess 24, so that such shoulder and recess both lie in solid metal.

The key-removable core 10 comprises a lock body 28 forming a cylindrical key plug housing 30 adapted to slidably fit in the lower lobe 16 of the cylinder, and a pin tumbler housing 32 which is receivable within the upper lobe 18 of the chamber and which in this modification is preferably in the form of a flat flange extending radially from the key plug housing 30 and defined by parallel flat sides 34. The pin tumbler housing 32 contains a series of axially spaced pin tumbler barrels 38 which receive stacks of pin tumblers 40 urged downward by springs 42. The top ends of the barrels are closed by a cap 44 slidably engaged over ribs 36 formed at the upper edges of the side faces 34.

The key plug housing in this preferred modification extends forward from the rear of the core body sufficiently to support the key plug and preferably to contain at least half of the pin tumbler barrels, here shown as four of the six tumbler barrels, and terminates in a flat front face. The pin tumbler housing 32 extends forward beyond the key plug housing 30 through an extension 33 which contains at least one pin tumbler barrel, and preferably two pin tumbler barrels as shown. A control sleeve 46 is mounted ahead of the key plug housing 30 and is in the form of a cylinder having the same internal and external diameters as the key plug housing 30 and a length substantially equal to that of the forward extension of the pin tumbler housing 32. Such sleeve contains two bores 48 which form intermediate sections of the two front pin tumbler barrels 38. The control sleeve 46 carries a retaining lug 50 which protrudes radially therefrom and is movable therewith through limited rotation between a projected position shown in full lines in FIGS. 1 and 2 where it is engaged in the recess 24 of the cylinder 12 and behind the shoulder 26, and a retracted position shown in dotted lines in FIG. 2 in which the lug moves against a side face of the pin tumbler housing and lies within clearance space between such side face and the side wall of the figure-8-shaped chamber so as to permit the core to be inserted and removed from that chamber.

A face plate 52 is mounted at the front of the core 10. This has an upper lobe which fits within the upper lobe 18 of the core chamber and a lower lobe in the form of a ring 54 defining a key plug opening in alignment with the key plug opening of the key plug housing 30. Such opening is desirably counterbored to receive the overlying front flange of the key plug.

A key plug 56 is rotatably mounted within the key plug chamber defined by the key plug housing 30 and the control sleeve 46. The key plug comprises a cylindrical barrel with a radial flange 58 at its front end, with a key slot 60 extending axially throughout its length, and with pin tumbler bores aligned with the housing barrels and extending into the key slot. The flange 58 of the key plug engages the lower lobe of the front face 52 to hold the front face in place. Desirably, the rear side of the upper lobe of the face plate 52 contains a vertical slot 62, in which the front end of the pin tumbler housing 32 is engaged to key the face plate against rotation about the axis of the key plug. The rear end of the key plug 56 is externally threaded for the reception of a cap nut 62 which bears against the rear face of the core body to secure the key plug 56 in place. The cap nut 62 also traps against the rear end of the key plug a throw plate 64 having a transverse slot which receives a throw member in the form of a spade 66. A blocker plate 68 lies in a short bore in the key plug, behind the space 66 and supports such space against retraction. A spring-pressed locking pin 70 mounted in the rear end of the key plug 56 locks the throw disk 64 against rotation, and has a reduced end portion which engages in notches in the inner periphery of the cap nut 62 to lock such nut in adjusted position.

As shown in FIG. 1, the throw spade 66 is engaged in a transverse slot 74 in a bolt-retraction element 72 of a secondary lock mechanism which may be of any desired type. The angle of rotation required to retract the retainer lug 50 may be of the order of 15°, and such rotation will also rotate the throw spade 66 through a similar angle. In order to accomodate this partial rotation of the spade 66 while the bolt-retraction element 72 remains in a normal position, the opening 74 in such bolt-retraction element which receives the throw spade 66 is made fan-shaped as shown in FIG. 1 so that the spade will be aligned for entry therein with the retaining lug 50 retracted and will be free to rotate through the angle required to move the retaining lug 50 between its projected and retracted positions without actuating the bolt-retraction element 72.

Figure 3:
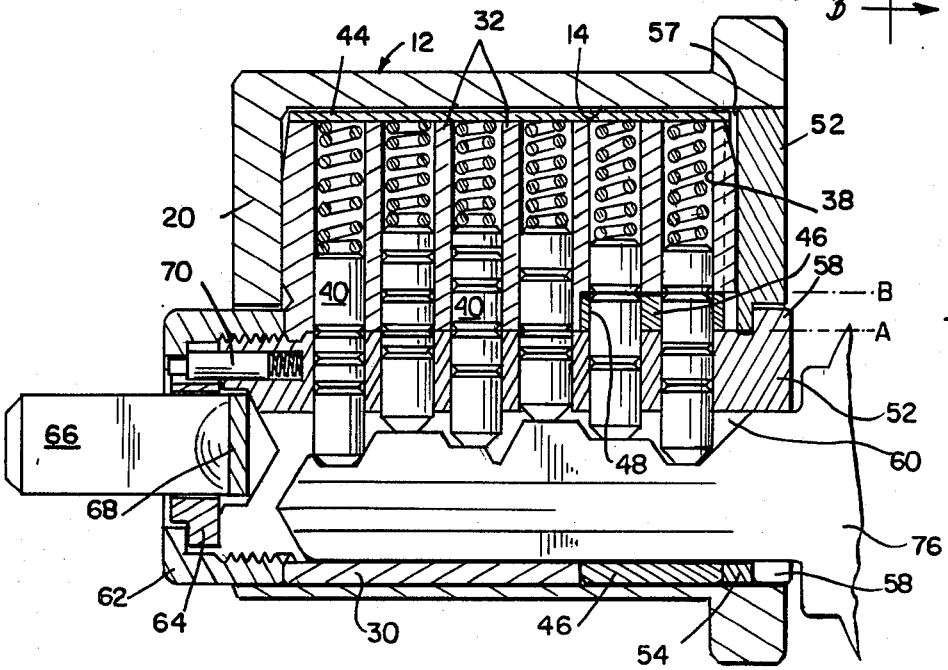
FIG. 3 is a longitudinal section taken on the line 3—3 of FIG. 2.

The arrangement described provides two shear lines for the stacks of pin tumblers 40 in the pin tumbler barrels 38. An operating shear line A is defined between the peripheral surface of the key plug 56 and the key plug chamber formed at the rear by the key plug housing 60 and at the front by the inner periphery of the control sleeve 46. A customary operating key will bring shear faces in the pin tumbler stacks 40 to that shear line to allow the key plug 56 to be rotated to operate the lock. A second or control shear line B is formed between the outer periphery of the control sleeve 46 and the overlying forward extension 33 of the pin tumbler housing 32. Insertion of a control key 70, as shown in FIG. 3, will bring shear faces in the front two pin tumbler stacks to that control shear line B, but not to the operating shear line A, and will bring shear faces in the remainder of the pin tumbler barrels to the operating shear line A. The control sleeve 46 will then be locked to the key plug 56 and the control key 70 may then be turned through a limited throw to swing the retaining lug 50 between its projected position shown in full lines in FIG. 2 and its retracted position shown in dotted lines in FIG. 2. This will concurrently carry the stop lug 51 from its stop position against a side face 34 of the pin tumbler housing 32 outward to an end position shown in dotted lines in FIG. 2, where it will be stopped by engagement of the retaining lug 50 against the other side face of the pin tumbler housing and where it will still lie within the profile of the core chamber so as not to interfere with the insertion and removal of the core from that chamber.

Operation of the modification of FIGS. 1–5 is as follows. The normal condition of the core 10 is as shown in full lines in FIGS. 1 and 2, in which the retaining lug 50 is in projected position, extending beyond the profile of the figure-8 shaped chamber 14 of the cylinder 12. For purposes of inserting the core in such chamber, a control key 70 is inserted in the key plug and is so combinated that in the pin tumbler stacks in the front two barrels 38 which pass through the control sleeve 46 it brings shear lines into alignment with the control shear line B between such control sleeve 46 and the overlying forward extension 33 of the pin tumbler housing 32 of the core, and also brings shear faces in the other four pin tumbler stacks into alignment with the operating shear line A between the key plug 56 and the key plug housing 30. The control sleeve 46 is then locked to the key plug 56 by one or more tumblers in the front two barrels, and rotation of the key 70 clockwise rotates the key plug 56 and the control sleeve 46 together to carry the retaining lug 50 from its projected position shown in full lines in FIG. 2 to its retracted position shown in dotted lines in FIG. 2. This brings the retaining lug into the clearance space within the profile of the figure-8-shaped chamber 14 and allows the core to be inserted endwise into the open end of that chamber. The rear end of the pin tumbler housing 32 seats as a stop against the rear wall 20 of the cylinder, and this brings the retaining lug 50 into alignment with the recess 24 in the side wall of the core chamber. The key 70 is then rotated counterclockwise to swing the retaining lug 50 into such recess and into retaining engagement with the shoulder 26 at the front of such recess so as to lock the core in place in the core chamber of the cylinder 12. The control key is then retracted, and the lock is ready for operation by an operating key in the usual manner. Such operating key aligns shear faces in all of the pin tumbler stacks with the operating shear line A at the outer surface of the key plug 56, while leaving at least one tumbler pin across the control shear line so that the key plug 56 may be turned by such operating key to rotate the throw spade 66 and thereby actuate the bolt-retraction element 72 of the secondary lock mechanism to advance or retract the lock bolt in the usual way.

The modification of FIGS. 6 and 7 differs from that of FIGS. 1–5 primarily in that the operating shear line and control shear line are spaced a greater distance apart. The core body 128 is substantially identical with that of the earlier modification, and comprises a key plug housing 130 and a pin tumbler housing 132. The forward extension 133 of such pin tumbler housing, however, has its inner edge spaced from the surface of the key plug 156 a greater distance than in the previous modification. The control sleeve 146, in the segment 145 of its periphery circumferentially between the retaining lug 150 and the stop lug 151, and radially lies between the two shear lines, has a wall thickness which is substantially greater than the wall thickness of the remaining arcuate segment 147 of the peripheral wall of such control sleeve 146. For combinating purposes, it is desirable to use pin tumblers which differ in length by whole numbers of increments of uniform length, to have such increments of such length as to provide clear separation between shear faces spaced from each other by single increments, and to have the two shear lines spaced apart by a large number of increments. In a specific embodiment of the core of FIGS. 1–5, the wall thickness of the control sleeve 46 between the lugs 50 and 51 had a design thickness of 0.060 inch, equivalent to four pin tumbler increments of 0.015 inch each. In an embodiment of the core of FIGS. 6 and 7, the wall segment 145 of the control sleeve 146 between the two lugs 150 and 151 had a design thickness of 0.150 inch, equivalent to eight combinating increments of 0.015 inch each. This permitted a much larger number of combinations in the front two pin barrels, and effectively increased to a substantial extent the key combinations available for use both at the operating shear line A and for control purposes. It is noted that control combinations include not only those in the front two pin barrels, where the pin tumbler shear lines are brought into alignment with the control shear line B, but also include those in the other pin tumbler barrels where, for operation of the control key, shear faces are brought into alignment with the operating shear line A.

The modified core of FIGS. 6 and 7 also differs from the core of FIGS. 1–5 in the means using for retaining the pin tumbler springs 142. The pin tumbler housing 132 is formed with flat sides which extend fully to the top of such pin tumbler housing and are there provided with bendable flanges 144 which are bent inward toward each other and over the top ends of such springs after the pin tumblers and springs are in place in the pin tumbler housing. While this is a known means for retaining such springs, it illustrates that the present invention permits use of any of various spring-retaining means.

The modification of FIGS. 8 and 9 differs from that of FIGS. 1–5 in three principal respects. The core body 228 is formed from an extruded bar of figure-8 cross section, complementary to the cross section of the core chamber 14 in the cylinder 12 shown in FIGS. 2–5, and includes a lower lobe forming a key plug housing 230 and an upper lobe forming a pin tumbler housing 232. The lower lobe and the forward extension 233 of the pin tumbler housing 232 are cut away to provide clearance space for a control sleeve 246 and to form flat sides 234 on such forward extension 233. Further, the end face of such forward extension 233 is formed with a key 235 and the face plate 52 is formed with a complementary recess 255 so that when the face plate is assembled to the core body, such face plate is not only locked against rotation about the axis of the key plug by engagement of the flat-sided forward end of the pin tumbler housing 232 in the vertical slot 257, but is also locked against radial movement with respect to such axis by engagement of the key 235 in the recess 255. The face plate then serves to support the key plug 256 at its forward end. The modification of FIGS. 8 and 9 also differs in that it uses a dove-tail slide 244 in a complementary groove to retain the pin tumbler springs 242 in place.

The use of the core body of full figure-8 cross section over at least the major portion of its length is at least permissible in accordance with the present invention, and may be desirable in certain applications. Its use permits a face of the full-bodied section, such as the front face 231 shown in FIG. 9, to be placed in supporting engagement against the retaining lug (not shown in these figures, but compare FIG. 10).

Figure 10:
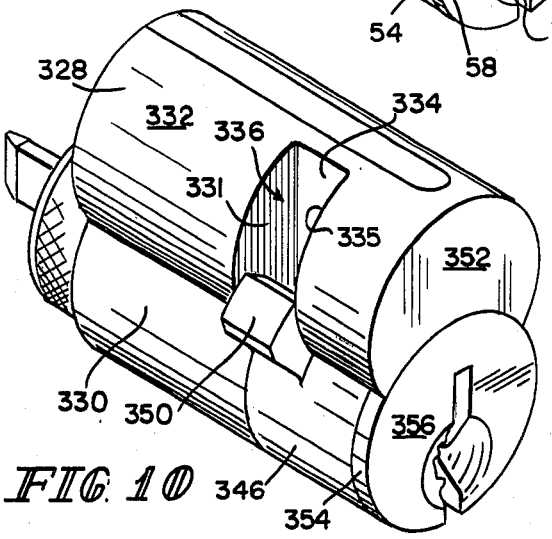
FIG. 10 is a perspective view showing a modification in which the upper lobe of the figure-8-shaped core body is extended to the front face of the core to form such front face.

In the modification of FIG. 10, the core body 328 is conveniently formed of a bar of figure-8 cross section and comprises two cylindrical lobes forming a key plug housing 330 and a pin tumbler housing 332. The forward end of the lower lobe of the core body is cut away to provide space for the control sleeve 346, while the forwardly extending portion 333 of the upper lobe is milled away at the sides over a limited length to form opposite side slots 336 with inner or bottom flat faces 334 analogous to the side faces 34 of the core of FIGS. 1–5 and with front and rear faces 331 and 335 which lie in close embracing and supporting relationship with the end faces of the retaining lug 350. The front end of the pin tumbler housing is left in full cylindrical section, and is extended forward to the front face 352 of the core so as to provide such face without the use of a separate face plate. In this modification of FIG. 10, the control sleeve 346 is extended forward into abutting relation with the rim flange 354 of the key plug 356.

The operation of the core of FIG. 10 is analogous to that of the other cores described. In this case, the retaining lug 350 is closely embraced and supported by the faces 331 and 335 of the slot milled in the side cheeks of the top lobe of the core body 328, so that such retaining lug 350 will transmit directly from the core body to the core receptacle end thrust such as may be exerted by attempts to pull the key plug or the core from the receptacle. The resulting core and lock will thus have high pull resistance.

Increased pull resistance and resistance to other attempts to force the lock are provided by the present invention in all its modifications. The control sleeve, 46 in FIGS. 1–5, is of substantially greater wall thickness and strength than the thin-walled sleeve of certain prior art structures; and the retaining lug, 50 in FIGS. 1–5, may be wider and especially much longer than in certain prior art structures by reason of the clearance space provided between the side wall of the core chamber and the spaced flat side face of the core body, such as the side face 34 in FIGS. 1–5, 234 in FIGS. 8 and 9, and 334 in FIG. 10.

The present invention is also advantageous in that the core body may be made either with a flat-sided pin tumbler housing as in FIGS. 1–5 which is analogous and may be identical to certain prior art lock cylinders in which such a flat-sided pin tumbler housing is used as a key to hold certain lock parts against relative rotation, for example, to hold a knob against relative rotation on a knob sleeve; and may optionally also be made with a full figure-8 cross section over part of substantially all of its length to suit applications where such configuration is functionally or otherwise desirable.

The present invention is also of advantage, especially with respect to pull resistance, in that the retaining lug, 50 in FIGS. 1–5, may be placed in a forward position where pull forces applied to the key plug will be transmitted to the core body, both by the rear key plug fastening such as the cap nut 62 and by pin tumblers in a plurality of pin tumbler barrels, and thence applied to the rear face of the control ring, and in the modifications of FIGS. 8–10 also directly against the rear face of the retaining lug of that control sleeve; and will also be transmitted directly to that control sleeve by pin tumblers in the forward pin tumbler barrels which pass through the control sleeve itself.

While only a cylinder-type core receptacle 12 is shown in the drawings, it is to be understood that the core of the present invention may be used with any of various other core receptacles or mountings, for example, with a knob spindle mounting as in U.S. Pat. No. 3,955,387 or with a padlock or the like. While the core is shown as provided with throw means in the form of a spade 66 carried by the rear end of the key plug, it will be understood that other throw means may be used, for example, that shown in U.S. Pat. No. 3,955,387 in which the key plug is provided with a pair of spaced axial holes in its rear end which are engaged by a pair of legs fixed to a rotary throw member mounted behind the core.

What is claimed is:

1. A key-removable lock core for use in a receptacle defining a core-receiving opening having a first cylindrical portion for axially slidably receiving the key plug housing of a core and an adjoining second portion for receiving the pin tumbler housing of such core, and having a side wall defining a rearward-facing shoulder spaced inward from the core-receiving end of such receptacle for engagement by a core-retaining lug on such core, comprising a core body having a key plug housing defining a cylindrical chamber to receive an axial portion of a rotatable key plug, and having a pin tumbler housing containing an axial series of pin tumbler barrels, said key plug housing extending over a length of the core sufficient to support the key plug coaxially therewith and having a cut-away portion, and the pin tumbler housing having an integral portion extending across the cut-away portion of the key plug housing and containing at least one pin tumbler barrel, a control sleeve positioned coaxially with the key plug housing in said cut-away portion thereof and defining a cylindrical chamber in alignment with that of the key plug housing to receive a portion of the key plug, said control sleeve having a pin tumbler bore therein aligned with each barrel in the integral portion of the pin tumbler housing, a key plug in said chambers, said integral portion of the pin tumbler housing having a side face spaced from said side wall of the core receptacle so as to define a clearance space between itself and such side wall for the reception of a retaining lug, the interface between the key plug and its surrounding core body and control sleeve providing an operating shear line and the interface between the control sleeve and the extended portion of the pin tumbler housing forming a control shear line for the core, a retaining lug on said control sleeve extending radially outward therefrom to a distance greater than the radius to the control shear line so as to stand outward from the cylinder defined by such control shear line, said retaining lug being movable by rotation of the control sleeve between a retracted position within said clearance space so as to clear said receptacle side wall and permit insertion of the core into the receptacle and a projected position for engagement behind the rearward-facing shoulder of said receptacle so as to retain the core therein, said integral portion of the pin tumbler housing having on its other side a stop side face spaced from the other side of the core receptacle so as to define a second clearance space between itself and such other side wall, and a stop lug on said control sleeve movable within such second clearance space and against said stop side face for stopping the retaining lug in its projected position.

2. A key-removable lock core for use in a receptacle defining a core-receiving opening having a first portion for axially slidably receiving the key plug housing of a core and an adjoining second portion for receiving the pin tumbler housing of such core, and having a side wall defining a rearward-facing shoulder spaced inward from the core-receiving end of such receptacle for engagement by a core-retaining lug on such core, comprising a core body having a key plug housing at the rear end thereof defining a cylindrical chamber to receive a rear end portion of a rotatable key plug, and having a pin tumbler housing containing an axial series of pin tumbler barrels, said key plug housing extending from the rear end of the body toward the front end through a length adapted to support the key plug coaxially therewith and the pin tumbler housing having a front extended portion in the form of a flat flange beyond the key plug housing over a length containing at least one pin tumbler barrel, a control sleeve positioned coaxially with the key plug housing and defining a cylindrical chamber in alignment with that of the key plug housing to receive a front portion of the key plug, said control sleeve having a pin tumbler bore therein aligned with each barrel in the extended portion of the pin tumbler housing, a key plug in said chambers, said extended portion of the pin tumbler housing having a side face spaced from said side wall of the core receptacle so as to define a clearance space between itself and such side wall for the reception of a retaining lug, a retaining lug on said control sleeve and movable thereby between a retracted position within said clearance space so as to clear said receptacle side wall and permit insertion of the core into the receptacle and a projected position for engagement behind the rearward-facing shoulder of said receptacle so as to retain the core therein, the interface between the key plug and the chamber defined by the core body and the control sleeve providing an operating shear line and the interface between the control sleeve and the extended portion of the pin tumbler housing forming a control shear line for the core, and a face plate at the front end of such pin tumbler housing, formed with a vertical slot in which the pin tumbler housing is engaged to key the housing to the plate.

3. A key-removable lock core for use in a receptacle defining a core-receiving opening having a first cylindrical portion for axially slidably receiving the key plug housing of a core and an adjoining second portion for receiving the pin tumbler housing of such core, and having a side wall defining a rearward-facing shoulder spaced inward from the core-receiving end of such receptacle for engagement by a core-retaining lug on such core, comprising a core body having a key plug housing defining a cylindrical chamber to receive an axial portion of a rotatable key plug, and having a pin tumbler housing containing an axial series of pin tumbler barrels, said key plug housing extending over a length of the core sufficient to support the key plug coaxially therewith and having a cut-away portion, and the pin tumbler housing having an integral portion extending across the cut-away portion of the key plug housing and containing at least one pin tumbler barrel, a control sleeve positioned coaxially with the key plug housing in said cut-away portion thereof and defining a cylindrical chamber in alignment with that of the key plug housing to receive a portion of the key plug, said control sleeve having a pin tumbler bore therein aligned with each barrel in the integral portion of the pin tumbler housing, a key plug in said chambers, said integral portion of the pin tumbler housing having a side face spaced from said side wall of the core receptacle so as to define a clearance space between itself and such side wall for the reception of a retaining lug, the interface between the key plug and its surrounding core body and control sleeve providing an operating shear line and the interface between the control sleeve and the extended portion of the pin tumbler housing forming a control shear line for the core, a retaining lug on said control sleeve extending radially outward therefrom to a distance greater than the radius to the control shear line so as to stand outward from the cylinder defined by such control shear line, said retaining lug being movable by rotation of the control sleeve between a retracted position within said clearance space so as to clear said receptacle side wall and permit insertion of the core into the receptacle and a projected position for engagement behind the rearward-facing shoulder of said receptacle so as to retain the core therein, said key plug housing being at the rear end of the core and the pin tumbler housing extending forward thereform, and a separate face plate at the front end of such pin tumbler housing and keyed to such housing, said face plate including a rim portion which surrounds the forward end of the key plug and being mechanically interlocked with said pin tumbler housing against relative rotational and radial movement with respect to the key plug axis so as to support the forward end of the key plug in coaxial relation with the key plug housing at the rearward end thereof.

4. Apparatus as in claim 2 in which said face plate includes a rim portion in supporting relation with the forward end of the key plug with the addition of a key on one of said pin tumbler housing and face plate engaged in a recess in the other thereof for interlocking the face plate against radial movement relative to the key plug axis so as to support the plug on such axis.

* * * * *